US005833318A

United States Patent [19]

Knight

[11] Patent Number: 5,833,318

[45] Date of Patent: Nov. 10, 1998

[54] WHEELCHAIR SUPPORT ACCESSORY

[76] Inventor: Tony A. Knight, 100 Manor Road., Mitcham, Surrey, CR41JB, United Kingdom

[21] Appl. No.: 974,057

[22] Filed: Nov. 19, 1997

[51] Int. Cl.[6] ..... A47C 16/00

[52] U.S. Cl. ..... 297/423.4; 297/DIG. 4

[58] Field of Search ..... 297/230.12, 352, 297/440.2, 440.22, DIG. 6, 440.13, 230.1, 230.2, 423.39, 423.4, DIG. 4, 423.1, 85, 411.23, 397, 440.1; 280/250.1, 291, 304.1

[56] References Cited

U.S. PATENT DOCUMENTS

| | | |
|---|---|---|
| 2,986,437 | 5/1961 | Davis . |
| 3,460,790 | 8/1969 | Baird . |
| 4,433,753 | 2/1984 | Watson . |
| 4,834,450 | 5/1989 | Stickler . |
| 4,881,779 | 11/1989 | Bubien . |
| 5,475,880 | 12/1995 | Guenther . |
| 5,568,933 | 10/1996 | Mizuno . |

FOREIGN PATENT DOCUMENTS

| | | |
|---|---|---|
| 1052913 | 12/1966 | United Kingdom . |

*Primary Examiner*—Milton Nelson, Jr.

[57] ABSTRACT

A wheelchair support accessory for providing added comfort to a person confined to a wheelchair includes a support board having a generally rectangular configuration. The support board has a long top edge, a long bottom edge and short opposed side edges. The long bottom edge has a pair of upwardly extending recesses formed therein disposed inwardly of the opposed short side edges. The recesses are spaced so as to engage an existing leg rest frame of a wheelchair.

14 Claims, 2 Drawing Sheets

FIG 1
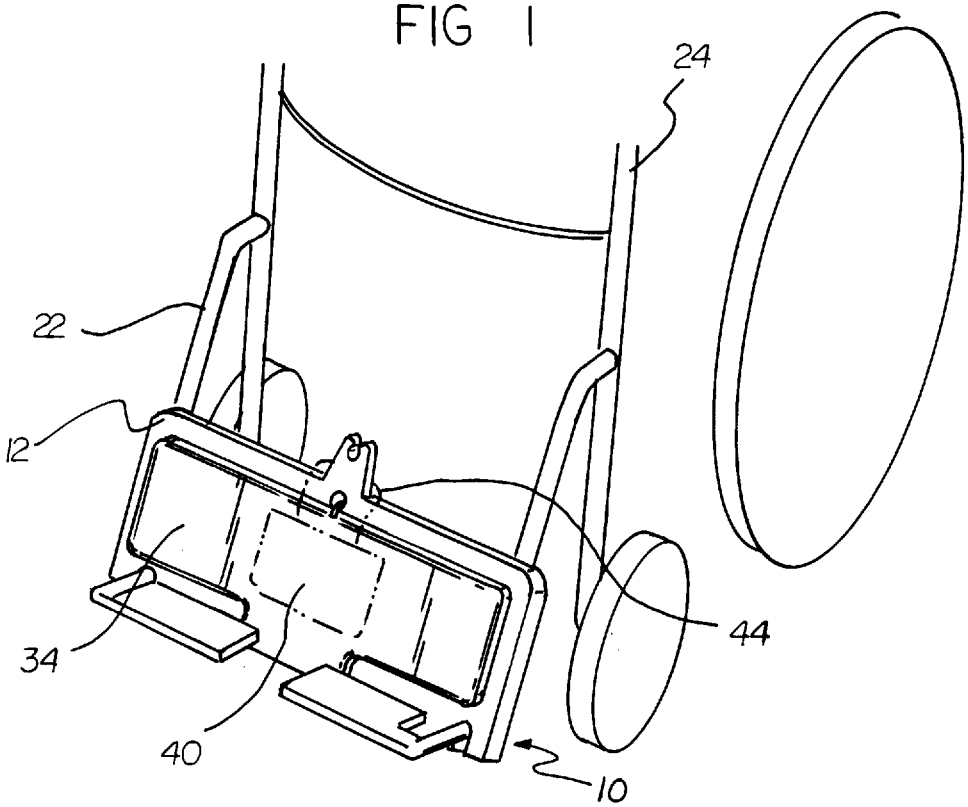
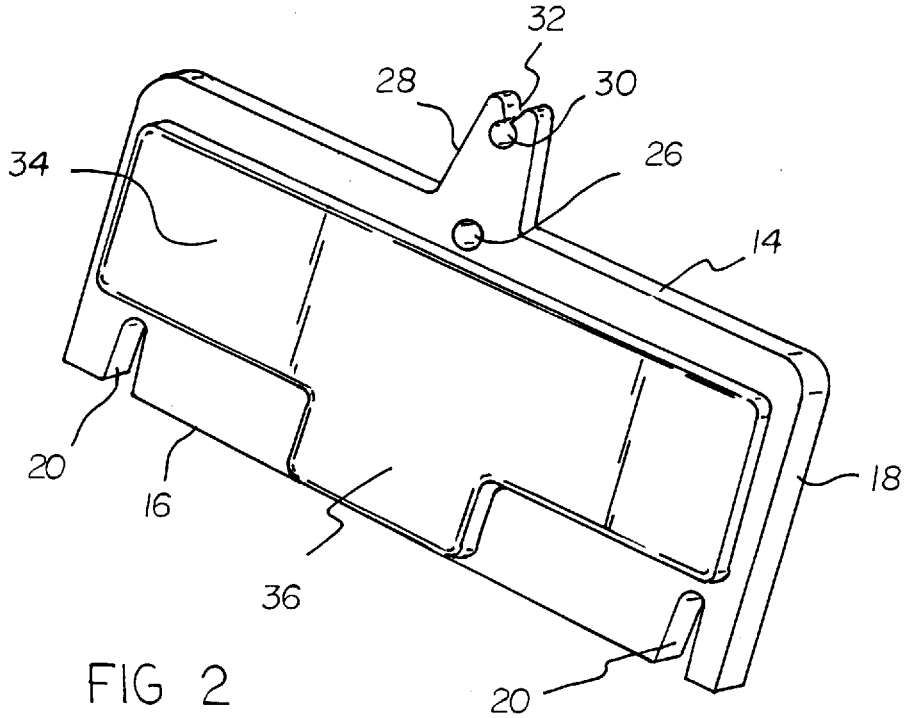
FIG 2

FIG 3
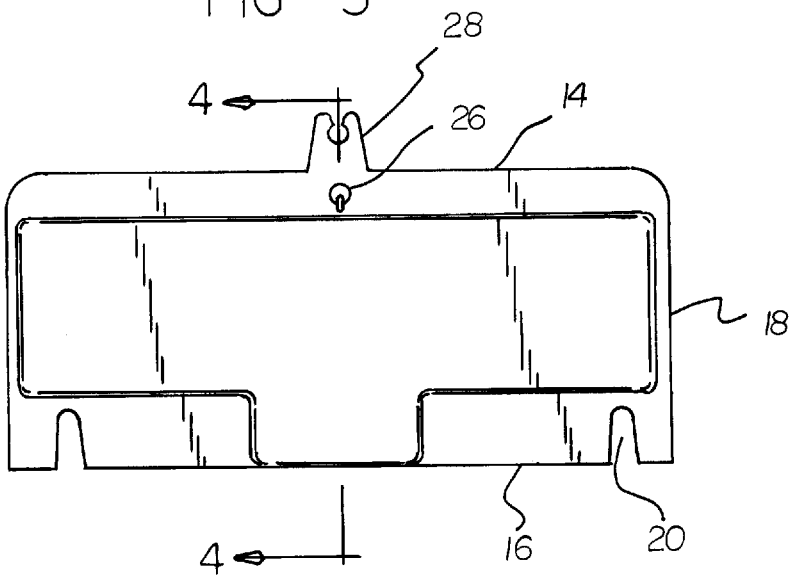
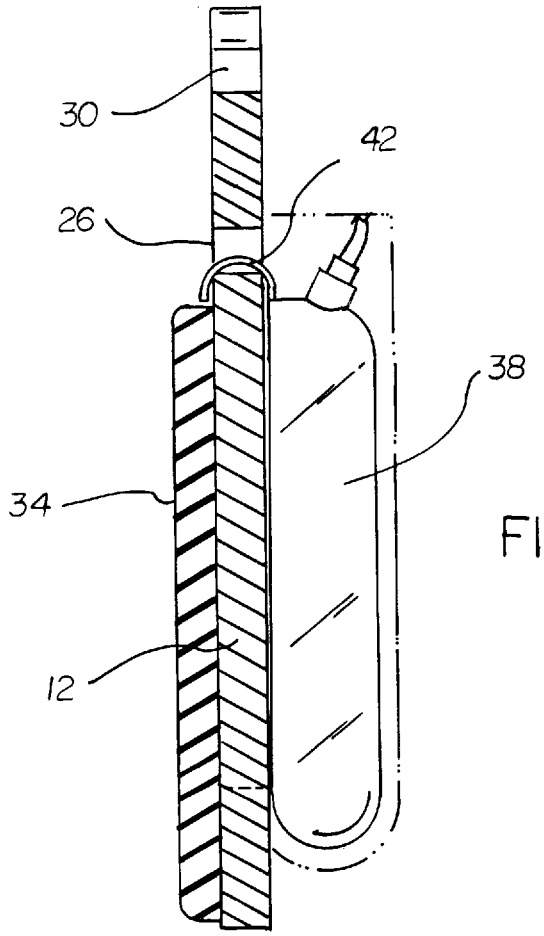
FIG 4

WHEELCHAIR SUPPORT ACCESSORY

BACKGROUND OF THE INVENTION

1. Field of the Invention

The present invention relates to wheelchair leg supports and more particularly pertains to a new wheelchair support accessory for providing added comfort to a person confined to a wheelchair.

2. Description of the Prior Art

The use of wheelchair leg supports is known in the prior art. More specifically, wheelchair leg supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art wheelchair leg supports include U.S. Pat. No. 4,486,048 to Meyer; U.S. Pat. No. 4,227,742 to Thomas; U.S. Pat. No. Des. 340,594 to Lambert; U.S. Pat. No. 4,564,238 to Wolpert, Jr.; U.S. Pat. No. 3,863,984 to Sickels; and U.S. Pat. No. 3,860,285 to Hartman.

While these devices fulfill their respective, particular objectives and requirements, the aforementioned patents do not disclose a new wheelchair support accessory. The inventive device includes a support board having a generally rectangular configuration. The support board has a long top edge, a long bottom edge and short opposed side edges. The long bottom edge has a pair of upwardly extending recesses formed therein disposed inwardly of the opposed short side edges. The recesses are spaced so as to engage an existing leg rest frame of a wheelchair.

In these respects, the wheelchair support accessory according to the present invention substantially departs from the conventional concepts and designs of the prior art, and in so doing provides an apparatus primarily developed for the purpose of providing added comfort to a person confined to a wheelchair.

SUMMARY OF THE INVENTION

In view of the foregoing disadvantages inherent in the known types of wheelchair leg supports now present in the prior art, the present invention provides a new wheelchair support accessory construction wherein the same can be utilized for providing added comfort to a person confined to a wheelchair.

The general purpose of the present invention, which will be described subsequently in greater detail, is to provide a new wheelchair support accessory apparatus and method which has many of the advantages of the wheelchair leg supports mentioned heretofore and many novel features that result in a new wheelchair support accessory which is not anticipated, rendered obvious, suggested, or even implied by any of the prior art wheelchair leg supports, either alone or in any combination thereof.

To attain this, the present invention generally comprises a support board having a generally rectangular configuration. The support board has a long top edge, a long bottom edge and short opposed side edges. The long bottom edge has a pair of upwardly extending recesses formed therein disposed inwardly of the opposed short side edges. The recesses are spaced so as to engage an existing leg rest frame of a wheelchair. The support board has an aperture therethrough downwardly of the long top edge thereof. The long top edge has a support extension secured thereto and extending upwardly therefrom. The support extension has an aperture therethrough. A groove extends downwardly from an upper edge of the support extension into the aperture thereof. A pad is secured to a front surface of the support board. The pad has a generally rectangular configuration. The pad includes a lower extension portion extending downwardly from a lower edge thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wheelchair support accessory apparatus and method which has many of the advantages of the wheelchair leg supports mentioned heretofore and many novel features that result in a new wheelchair support accessory which is not anticipated, rendered obvious, suggested, or even implied by any of the prior art wheelchair leg supports, either alone or in any combination thereof.

It is another object of the present invention to provide a new wheelchair support accessory which may be easily and efficiently manufactured and marketed.

It is a further object of the present invention to provide a new wheelchair support accessory which is of a durable and reliable construction.

An even further object of the present invention is to provide a new wheelchair support accessory which is susceptible of a low cost of manufacture with regard to both materials and labor, and which accordingly is then susceptible of low prices of sale to the consuming public, thereby making such wheelchair support accessory economically available to the buying public.

Still yet another object of the present invention is to provide a new wheelchair support accessory which provides in the apparatuses and methods of the prior art some of the advantages thereof, while simultaneously overcoming some of the disadvantages normally associated therewith.

Still another object of the present invention is to provide a new wheelchair support accessory for providing added comfort to a person confined to a wheelchair.

Yet another object of the present invention is to provide a new wheelchair support accessory which includes a support board having a generally rectangular configuration. The support board has a long top edge, a long bottom edge and short opposed side edges. The long bottom edge has a pair of upwardly extending recesses formed therein disposed inwardly of the opposed short side edges. The recesses are spaced so as to engage an existing leg rest frame of a wheelchair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new wheelchair support accessory according to the present invention illustrated in use.

FIG. 2 is an isolated perspective view of the present invention.

FIG. 3 is a front elevation view of the present invention.

FIG. 4 is a cross-sectional view of the present invention as taken along line 4—4 of FIG. 3.

DESCRIPTION OF THE PREFERRED EMBODIMENT

With reference now to the drawings, and in particular to FIGS. 1 through 4 thereof, a new wheelchair support accessory embodying the principles and concepts of the present invention and generally designated by the reference numeral 10 will be described.

As best illustrated in FIGS. 1 through 4, the wheelchair support accessory 10 comprises a support board 12 having a generally rectangular configuration. The support board 12 has a long top edge 14, a long bottom edge 16 and short opposed side edges 18. The long bottom edge 16 has a pair of upwardly extending recesses 20 formed therein disposed inwardly of the opposed short side edges 18. The recesses 20 are spaced so as to engage an existing leg rest frame 22 of a wheelchair 24. The support board 12 has an aperture 26 therethrough downwardly of the long top edge 14 thereof. The long top edge 14 has a support extension 28 secured thereto and extending upwardly therefrom. The support extension 28 has an aperture 30 therethrough. A groove 32 extends downwardly from an upper edge of the support extension 28 into the aperture 30 thereof.

A pad 34 is secured to a front surface of the support board 12. The pad 34 has a generally rectangular configuration. The pad 34 includes a lower extension portion 36 extending downwardly from a lower edge thereof.

In use, the device 10 would provide greater support to the user's feet and legs by providing a cushioned resting area. Further, the placement of the device 10 would prevent legs or feet from slipping off or behind the foot rests or calf supports found on wheelchairs 24, thus reducing the risk of serious injury. In addition, the device 10 would facilitate locking the leg rests in place and, lastly, the device 10 would provide an ideal location for securing a urinary drainage bag 38 behind the support board 12 and/or a storage pouch 40 in front of the support board 12. The aperture 26 through the support board 12 would receive a hook 42 of the urinary drainage bag 38 therein for support of the urinary support bag 38 with respect to the support board 12. A handle 44 of storage pouches 40 or bags could be secured to the support extension 28 simply by pressing the handle 44 through the groove 32 until the handle 44 is positioned within the aperture 30 in the support extension 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new wheelchair support accessory for providing added comfort to a person confined to a wheelchair comprising, in combination:

a support board having a generally rectangular configuration, the support board having a long top edge, a long bottom edge and short opposed side edges, the long bottom edge having a pair of upwardly extending recesses formed therein disposed inwardly of the opposed short side edges, the recesses being spaced so as to engage an existing leg rest frame of a wheelchair, the support board having an aperture therethrough downwardly of the long top edge thereof, the long top edge having a support extension secured thereto and extending upwardly therefrom, the support extension having an aperture therethrough, a groove extending downwardly from an upper edge of the support extension into the aperture thereof; and a pad secured to a front surface of the support board, the pad having a generally rectangular configuration, the pad including a lower extension portion extending downwardly from a lower edge thereof.

2. A new wheelchair support accessory for providing added comfort to a person confined to a wheelchair comprising, in combination:

a support board having a generally rectangular configuration, the support board having a long top edge, a long bottom edge and short opposed side edges, the long bottom edge having a pair of upwardly extending recesses formed therein disposed inwardly of the opposed short side edges, the recesses being spaced so as to engage an existing leg rest frame of a wheelchair;

wherein the long top edge has a support extension secured thereto and extending upwardly therefrom, the support extension has an aperture therethrough; and a groove extending downwardly from an upper edge of the support extension into the aperture thereof.

3. The wheelchair support accessory as set forth in claim 2 wherein the support board has an aperture therethrough downwardly of the long top edge thereof.

4. The wheelchair support accessory as set forth in claim 2 and further including a pad secured to a front surface of the support board.

5. The wheelchair support accessory as set forth in claim 2 wherein the pad has a generally rectangular configuration, the pad including a lower extension portion extending downwardly from a lower edge thereof.

6. A wheelchair and support accessory for providing added comfort to a person confined to a wheelchair comprising, in combination:

a wheelchair having a leg rest frame;

a support board having a generally rectangular configuration, the support board having a long top edge, a long bottom edge and short opposed side edges, the long bottom edge having a pair of upwardly extending recesses formed therein disposed inwardly of the opposed short side edges, the recesses being spaced so as to engage the leg rest frame of the wheelchair.

7. The wheelchair and support accessory as set forth in claim 6 wherein the support board has an aperture therethrough downwardly of the long top edge thereof.

8. The wheelchair and support accessory as set forth in claim 6 further comprising:

wherein the long top edge has a support extension secured thereto and extending upwardly therefrom, the support extension has an aperture therethrough;

a groove extending downwardly form an upper edge of the support extension into the aperture thereof;

a pad secured to a front surface of the support board;

wherein the pad has a generally rectangular configuration, the pad including a lower extension portion extending downwardly from a lower edge thereof; and wherein the support board has an aperture therethrough downwardly of the long top edge thereof.

9. The wheelchair and support accessory of claim 6 wherein the leg rest frame of said wheelchair comprises a pair of laterally spaced and vertically slanted frame supports and a pair of laterally spaced and horizontally slanted frame rods, each of said frame rods being mounted to a lower portion of said frame supports, said support board being positioned in a slanted position resting against said frame supports with the recesses of said support board each having a frame rod positioned therein to resist lateral movement of said support board with respect to said leg rest frame.

10. The wheelchair and support accessory of claim 9 wherein said leg rest frame includes a pair of foot supports, each of said foot supports being mounted on one of said frame rods, said foot supports extending laterally inward toward each other, and wherein the recesses of said support board have a depth such that said support board extends below the level of the foot supports to place the foot supports in front of the support board to hold the support board adjacent to the frame supports.

11. The wheelchair and support accessory as set forth in claim 8 further including a pad secured to a front surface of the support board.

12. The wheelchair and support accessory as set forth in claim 11 wherein the pad has a generally rectangular configuration, the pad including a lower extension portion extending downwardly from a lower edge thereof.

13. The wheelchair and support accessory of claim 6 wherein the long top edge has a support extension secured thereto and extending upwardly therefrom, the support extension has an aperture therethrough.

14. The wheelchair and support accessory of claim 13 further comprising:

a groove extending downwardly from an upper edge of the support extension into the aperture thereof.

* * * * *